US009580881B2

(12) United States Patent
LaCroix

(10) Patent No.: US 9,580,881 B2
(45) Date of Patent: Feb. 28, 2017

(54) RETAINING WALL CONTAINING WALL BLOCKS WITH WEIGHT BEARING PADS

(71) Applicant: David M. LaCroix, St. Paul, MN (US)

(72) Inventor: David M. LaCroix, St. Paul, MN (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

(21) Appl. No.: 14/507,295

(22) Filed: Oct. 6, 2014

(65) Prior Publication Data

US 2015/0023741 A1 Jan. 22, 2015

Related U.S. Application Data

(63) Continuation of application No. 13/759,511, filed on Feb. 5, 2013, now abandoned, which is a continuation (Continued)

(51) Int. Cl.
*E04C 1/00* (2006.01)
*E02D 29/02* (2006.01)

(Continued)

(52) U.S. Cl.
CPC ..... *E02D 29/025* (2013.01); *B28B 3/021* (2013.01); *B28B 7/0097* (2013.01); *B28B 7/241* (2013.01); *E04C 1/395* (2013.01)

(58) Field of Classification Search
CPC ..... E04C 1/00; E01C 5/00; E01C 5/04; E04B 2/12; E04B 2/22; E02D 29/02; E02D 29/025

(Continued)

(56) References Cited

U.S. PATENT DOCUMENTS 952,918 A 3/1910 Mann
1,219,127 A 3/1917 Marshall (Continued)

FOREIGN PATENT DOCUMENTS

CN 2915992 Y 6/2007
JP H 11-277514 A 10/1999

(Continued)

OTHER PUBLICATIONS

Definition of "between" as provided online by Merriam-Webster: http://www.merriam-webster.com/dictionary/between.*

(Continued)

*Primary Examiner* — William Gilbert
(74) *Attorney, Agent, or Firm* — Popovich, Wiles & O'Connell, P.A.

(57) ABSTRACT

A retaining wall having a plurality of courses of retaining wall blocks including a first upper course and a second lower course. Each retaining wall block has opposed front and rear faces, opposed first and second side surfaces, and opposed and substantially parallel upper and lower surfaces, and at least one weight bearing pad extends from one of the upper and lower surfaces. The at least one weight bearing pad extends substantially from the rear face to the front face of the block. The weight bearing pads are the only areas of contact between the blocks in the first upper course and the blocks in the second lower course.

16 Claims, 14 Drawing Sheets

Related U.S. Application Data of application No. 12/266,951, filed on Nov. 7, 2008, now Pat. No. 8,800,235.

(60) Provisional application No. 60/986,483, filed on Nov. 8, 2007.

(51) Int. Cl.

| | |
|---|---|
| ***B28B 3/02*** | (2006.01) |
| ***B28B 7/00*** | (2006.01) |
| ***B28B 7/24*** | (2006.01) |
| ***E04C 1/39*** | (2006.01) |

(58) Field of Classification Search

USPC ..... 52/561, 566, 569, 574, 603, 608–611, 52/45.05, 745.09, 745.1, 745.17; 405/284, 286; D25/113, 114

See application file for complete search history.

(56) References Cited

U.S. PATENT DOCUMENTS

| | | | |
|---|---|---|---|
| D62,880 | S | 8/1923 | Castellani |
| D75,212 | S | 5/1928 | Clune |
| 1,953,005 | A | 3/1934 | Nagel |
| 2,121,450 | A | 6/1938 | Sentrop |
| D135,257 | S | 3/1943 | Larson |
| D185,611 | S | 6/1959 | Paulson |
| D186,371 | S | 10/1959 | Johnson |
| D188,320 | S | 7/1960 | Frese |
| 3,694,128 | A | 9/1972 | Foxen |
| 4,023,767 | A | 5/1977 | Fontana |
| 4,063,866 | A | 12/1977 | Lurbiecki |
| 4,098,865 | A | 7/1978 | Repasky |
| 4,218,206 | A | 8/1980 | Mullins |
| 4,335,549 | A | 6/1982 | Dean, Jr. |
| 4,426,176 | A | 1/1984 | Terada |
| 4,436,447 | A | 3/1984 | Crowe |
| 4,557,634 | A | 12/1985 | Vidal |
| 4,684,294 | A | 8/1987 | O'Neill |
| 4,698,949 | A | 10/1987 | Dietrich |
| 4,802,836 | A | 2/1989 | Whissell |
| 4,884,921 | A | 12/1989 | Smith |
| 4,909,717 | A | 3/1990 | Pardo |
| 5,062,610 | A | 11/1991 | Woolford et al. |
| 5,108,281 | A | 4/1992 | Pardo |
| 5,135,384 | A | 8/1992 | Redwine |
| 5,163,261 | A | 11/1992 | O'Neill |
| 5,281,125 | A | 1/1994 | Gebhardt |
| 5,484,236 | A | 1/1996 | Gravier |
| 5,598,679 | A | 2/1997 | Orton et al. |
| D392,052 | S | 3/1998 | Youssefian |
| 5,865,005 | A | 2/1999 | Cataldo |
| 5,930,964 | A | 8/1999 | Boechning |
| 6,106,264 | A | 8/2000 | Stenekes |
| 6,152,655 | A | 11/2000 | Hull |
| 6,322,742 | B1 | 11/2001 | Bott |
| 6,557,818 | B2 | 5/2003 | Manthci |
| 6,746,177 | B1 | 6/2004 | Hoashi |
| 6,773,642 | B1 | 8/2004 | Wardell |
| 6,829,867 | B2 | 12/2004 | Gresser et al. |
| D501,935 | S | 2/2005 | Dawson et al. |
| 6,854,702 | B2 | 2/2005 | Manthei et al. |
| D511,846 | S | 11/2005 | Evans |
| 6,978,580 | B1 | 12/2005 | Clark et al. |
| 7,048,250 | B2 | 5/2006 | Mothes |
| 7,090,439 | B1 | 8/2006 | Carey et al. |
| 7,140,867 | B2 | 11/2006 | Scherer et al. |
| 7,156,645 | B2 | 1/2007 | Ness |
| 7,175,414 | B2 | 2/2007 | Ness et al. |
| 7,179,077 | B2 | 2/2007 | Chennells |
| D538,946 | S | 3/2007 | Mugge et al. |
| D539,436 | S | 3/2007 | Magliocco et al. |
| D547,881 | S | 7/2007 | Price et al. |
| D548,367 | S | 8/2007 | Price |
| 7,261,548 | B2 | 8/2007 | Ness |
| 7,278,845 | B2 | 10/2007 | Krause et al. |
| D556,919 | S | 12/2007 | Price |
| 7,497,646 | B2 | 3/2009 | Price |
| D592,318 | S | 5/2009 | Ruegsegger |
| 7,645,098 | B1 | 1/2010 | Rainey |
| 2003/0002925 | A1 | 1/2003 | Blomquist et al. |
| 2003/0126821 | A1 | 7/2003 | Scherer et al. |
| 2003/0182011 | A1 | 9/2003 | Scherer |
| 2004/0118071 | A1 | 6/2004 | Price et al. |
| 2005/0016106 | A1 | 1/2005 | Dawson et al. |
| 2005/0158122 | A1 | 7/2005 | Lee |
| 2005/0211871 | A1 | 9/2005 | Ness et al. |
| 2006/0207206 | A1* | 9/2006 | Everett ..... E04B 2/06 52/604 |
| 2006/0209206 | A1 | 9/2006 | Wang et al. |

FOREIGN PATENT DOCUMENTS

| | | | |
|---|---|---|---|
| JP | 2000 054407 | A | 2/2000 |
| JP | 2005-67091 | A | 3/2005 |
| RU | 2001757 | C1 | 10/1993 |
| WO | WO 86/04947 | A1 | 8/1986 |
| WO | WO 2005/009707 | A1 | 2/2005 |
| WO | WO 2009/062000 | A2 | 5/2009 |

OTHER PUBLICATIONS

International Search Report and Written Opinion of PCT Application No. PCT/US2008/082749, dated Jul. 8, 2009, 16 pages total.
Abstract for CN2915992Y (1 page).
Abstract for JPH 11-277514 A (2 pages).
Abstract for JP 2005-67091 A (2 pages).
Nov. 19, 2014 Examination Report issued in European Patent Application No. 08846853.3 (7 pages).
Sep. 9, 2015 Examination Report issued in European Patent Application No. 08846853.3 (6 pages).
English abstract of JP 2000 054407 A (Keikon KK) Feb. 22, 2000 (1 page).

* cited by examiner

RETAINING WALL CONTAINING WALL BLOCKS WITH WEIGHT BEARING PADS

This application is a continuation of U.S. Ser. No. 13/759,511, filed Feb. 5, 2013, which is a continuation of U.S. Ser. No. 12/266,951, filed Nov. 7, 2008, which claims the benefit of U.S. Provisional Application No. 60/986,483, filed Nov. 8, 2007, entitled "Wall Block With Weight Bearing Pads and Method of Producing Wall Blocks", the contents of each of which are hereby incorporated by reference herein.

FIELD OF THE INVENTION

The present invention relates generally to concrete wall blocks. More particularly the invention relates to wide or oversized wall blocks having weight bearing pads and to compression head assemblies used during the process of manufacturing the wall blocks from a mold.

BACKGROUND OF THE INVENTION

Numerous methods and materials exist for the construction of retaining walls and landscaping walls. Such methods include the use of natural stone, poured in place concrete, masonry, and landscape timbers or railroad ties. In recent years, segmental concrete retaining wall units which are dry stacked (i.e., built without the use of mortar) have become a widely accepted product for the construction of retaining walls. Such products have gained popularity because they are mass produced, and thus relatively inexpensive. They are structurally sound, easy and relatively inexpensive to install, and couple the durability of concrete with the attractiveness of various architectural finishes.

It is desirable to build a wall from such blocks quickly and without the need for special skilled labor. The efficiency of building a wall can be measured by determining how fast the front face of a wall is constructed. Clearly, this depends on the size of the blocks used and ease of stacking the blocks.

It is standard practice in the prior art to use similarly sized mold boxes to produce various styles of block. For example, U.S. Patent Application Publication No. 2005/00161106 A1 entitled Method of Making Wall Block, the entirety of which is incorporated herein by reference, describes a standard size mold box of about 18 inches by about 24 inches (about 45.7 cm by about 61 cm), and about 8 inches (20.3 cm) deep. This standard size mold box is used to produce blocks of varying sizes. Since those blocks are typically formed in the mold with their front faces positioned along the 18 inch (45.7 cm) dimension these blocks have a front face with a dimension of 18 inches by 8 inches and a surface area of about one square foot (929 sq cm). The '106 application describes an improvement whereby two blocks are made in a standard size mold box with the front faces of the blocks formed along the 24 inch (61 cm) dimension. Those prior art blocks described in the '106 application are shown in FIG. 1. The blocks 10 are shown as they are formed within a mold box 20 and each has a front face that is about 24 inches by 8 inches (45.7 cm by 20.3 cm) and an area of about 1.33 square feet (0.124 square meter). This is larger than typical prior art blocks formed two at a time in the same size mold box which have a front face area of one square foot (0.0929 square meter). A larger front face is advantageous because more useable wall surface area is produced each mold cycle and wall construction speed and efficiency is increased because it takes fewer blocks that must be handled and aligned by laborers to build the same size wall.

During the block molding process the mold box is used to form multiple blocks at one time. The mold and a lower plate or production pallet form a cavity for the formation of blocks. Moldable material such as concrete having a composition well known to those of skill in the art is placed into the mold and allowed to set for a time sufficient to allow retention of block shape when the material is removed from the mold box. Often the blocks are formed in the mold box with their lower surface facing up and their upper surface facing down and resting against the pallet. Unless otherwise noted, that is the block orientation which is used in this application. As is well known in the art the material is removed with the aid of a compression head assembly which is lowered from above the mold box and urges the material out of the mold. Once the material is removed from the mold the material in the form and shape of a block or blocks is moved to a curing station where the blocks are allowed to cure while resting on the pallet. Another pallet is positioned under the mold to receive the moldable material which again fills the mold. In this way, many sets of multiple blocks are formed with one mold and many pallets.

During the block molding process it is important that the blocks are made of a uniform and consistent shape and size and that block dimensions, especially block height or thickness, are maintained within acceptable tolerances. This is important for all blocks but especially those made for use in dry stacked walls. There are various ways that the acceptable range of tolerance of block dimensions can be exceeded during the block molding process. Excessive wear or misalignment of the equipment and machinery used in the manufacturing process can result in the production of blocks having one or more dimensions that do not fall within acceptable tolerances. For example, irregularities in height can be the result of the blocks being formed on production pallets which have irregular surfaces. Production pallets can be made of various materials including steel, plastic and wood. Any irregularity in the surface of the production pallet will be imparted to blocks formed on that surface. Although this application focuses on problems caused by the use of fatigued and sagging production pallets it should be understood that the concepts disclosed herein are generally applicable to control tolerances and especially height/thickness tolerances of any wall block caused by any reason.

The size of a typical production pallet used in the block molding process is from 18 inches by 26 inches (46 cm by 66 cm) for the smallest pallet to 44 inches by 55 inches (112 cm by 140 cm). When the pallets are new the surface upon which the blocks are formed and cured is planar and level. The block surface resting against the pallet (typically the top surface of the block) is also planar and level since it assumes the contour of the surface of the pallet upon which it cures. However, older pallets which have been used in many production cycles can begin to sag. A block which is formed and cured on a sagging pallet or on a pallet having an irregular surface for other reasons will assume the contour of the pallet. Thus, the block will be formed with a top surface which is not planar. It is desirable that the dimensions of blocks made during this process are maintained within acceptable tolerances and that surfaces which are meant to be level are, in fact, level. This is especially true of blocks which are made with the intention that they will be dry stacked. In a wall where the blocks are connected with mortar it is possible to correct for misshapen blocks (blocks which do not fall within acceptable tolerances) by using more or less mortar. However, such correction is not possible in a dry stacked wall. If the blocks are small and the walls constructed with the blocks are not too high irregularities in block height created during the molding process may not affect use of the blocks. However, the problem is amplified in larger, wider blocks and blocks used to construct very tall walls. As discussed previously, the size and width of blocks varies depending on the size of the mold and the orientation of the blocks in the mold. For example, the width of blocks may range from less than one foot to two feet.

FIG. 2A is a front view of a prior art block 10*a* similar to those shown in FIG. 1. Block 10*a* is shown resting on a level pallet 30 while it cures. It can be seen that the top surface of block 10*a* which rests on the pallet is level. FIG. 2B is a front view of block 10*b* which is similar to the blocks shown in FIG. 1 except it is resting on a sagging pallet 40 while it cures. The drawing, which is somewhat exaggerated to make the concept clear, shows that the pallet may sag by a distance d which has been measured to be between about ⅛ inch to 3⁄32 inch (0.3 cm to 0.2 cm) at each end on pallets that have been in use for some time. The top surface of block 10*b*, which rests against the pallet, is formed with a curve or bow which results in the thickness of the block being greater at the center portion of the block than at the ends. This curve or bow in the block corresponds to the sag of the pallet causing the middle portion of the top surface to be higher than the ends by between about ⅛ inch to 3⁄32 inch (0.3 cm to 0.2 cm).

FIG. 3A shows a portion of a wall constructed with blocks 10*a* formed on a level pallet as shown in FIG. 2A. FIG. 3A shows that the thickness of the blocks is uniform and the tops and bottoms of the blocks in each course are level. The bottom surface of blocks in each course of blocks in the wall abuts against the top surface of the blocks in the next lower course without any gaps or areas of concentrated stress. This is the situation which is desired when the blocks are formed. FIG. 3B shows a portion of a wall constructed with blocks 10*b* formed on a sagging pallet as shown in FIG. 2B. This drawing is not to scale but is exaggerated to clearly show the increased block thickness at the middle portion of the blocks. The raised middle portion of the top surface of the blocks 10*b* is clearly visible. Unlike the wall of FIG. 3A the wall in FIG. 3B has areas of concentrated stress S at the top middle portion of each block in a lower course of blocks. The stress areas S are created where the raised middle portion of the top surface of the blocks contacts the blocks in the course of blocks above. FIG. 3B also shows that the portion of the block immediately below the areas of stress do not contact the blocks in the course below because that location is directly above the end portions of blocks in the lower course when the wall blocks are placed in a running bond pattern which is common when building landscape or retaining walls. The blocks are thinner at the end portions resulting in gaps between courses at those locations. Since there are gaps between the courses of blocks directly under the areas of concentrated stress there is no support provided by the underlying course of blocks at those areas. The result is that when the height of the wall is enough to create a downward force at the areas of concentrated stress S greater than the strength of the block to resist that stress without support from below a crack C can develop. The number of cracks which form in the face of the wall depends on the size of the blocks, the amount of the sag or curvature or thickness variation of the blocks, and the height of the wall. Cracks in the wall make the wall less aesthetically pleasing and, in extreme cases, if there are enough cracks can even affect the structural integrity of the wall.

Accordingly, there is a need in the art to compensate or correct for the dimensional intolerances which are created for various reasons during the block molding and curing process.

SUMMARY OF THE INVENTION

The present invention is directed generally at masonry wall blocks having weight bearing pads on an upper or lower surface and to methods of making such blocks. In one embodiment the invention is a wall block having a plurality of weight bearing pads on an upper or lower surface of the block. In another embodiment the invention is a compression head assembly having tamper heads which are used to form weight bearing pads on the upper or lower surface of a wall block during the block molding process. The invention also includes the blocks made with the compression head assembly and walls made from those blocks. The invention also includes a method of constructing a block wall from the blocks made from the compression head assembly. The invention also includes a method of leveling a surface of a block during the block forming process. This method includes measuring the block specifications during the forming process and removing material from a surface of the block or a portion of a surface of a block to level that portion of the surface of the block.

The invention provides a wall block comprising a block body having opposed front and rear faces, opposed first and second side surfaces, and opposed and substantially parallel upper and lower surfaces, at least one weight bearing pad extending from one of the upper and lower surfaces. In one embodiment, the weight bearing pad extends from the lower surface. In an embodiment, the block body comprises two weight bearing pads, and in another embodiment the block body comprises just two weight bearing pads. In an embodiment, the at least one weight bearing pad extends substantially from the rear face to the front face of the block body. In an embodiment, the at least one weight bearing pad is a rectangular prism. In one embodiment, the at least one weight bearing pad has a height of from ⅛ to ½ inch (0.3 to 1.3 cm), and in another embodiment the at least one weight bearing pad has a height of from ⅛ to ⅜ inch (0.3 to 1.0 cm). In an embodiment, the dimensions of the at least one weight bearing pad are from 1 to 3 inches (2.5 to 7.6 cm) wide, 7 to 11 inches (17.8 to 27.9 cm) long, and ⅛ to ⅜ inch (0.3 to 1.0 cm) deep. The at least one weight bearing pad can be level or have a slope.

The invention provides a compression head assembly for use in making wall blocks comprising: a stripper shoe including a bottom portion having at least one opening; and at least one adjustable tamper head sized to be accommodated within the at least one opening in the stripper shoe. In an embodiment, the at least one adjustable tamper head can be raised and lowered relative to the stripper shoe. In an embodiment, the at least one adjustable tamper head can be set at an angle relative to a horizontal plane of the stripper shoe. In one embodiment, the at least one adjustable tamper head can be set at an angle of from 0 to 5 degrees.

The invention provides a compression head assembly for use with a mold in making wall blocks comprising a stripper shoe including a bottom portion for contacting a wall block surface in the mold, the bottom portion having at least one indentation for imparting to the wall block surface at least one raised weight bearing pad.

The invention provides a method of making a plurality of retaining wall blocks comprising providing a mold assembly including a pallet, a compression head assembly, a mold box having at least one mold cavity having an open mold cavity top and an open mold cavity bottom, the mold cavity being shaped to form a single retaining wall block, each retaining wall block having opposed front and rear faces, opposed first and second side surfaces, and opposed and substantially parallel upper and lower surfaces, and at least one weight bearing pad extending from one of the upper and lower surfaces, the compression head assembly comprising a stripper shoe including a bottom portion having at least one opening and at least one adjustable tamper head sized to be accommodated within the at least one opening in the stripper shoe; positioning the pallet beneath the mold box to enclose the mold cavity bottom; filling the mold cavity with dry cast concrete; lowering the compression head assembly to enclose the open mold cavity top and compress the dry cast concrete within the mold cavity, the at least one weight bearing pad being formed adjacent the at least one adjustable tamper head; and lowering the pallet and the compression head assembly to strip the dry cast concrete from the mold cavity.

The invention provides a method of making a plurality of retaining wall blocks comprising providing a mold assembly including a pallet, a compression head assembly, a mold box having at least one mold cavity having an open mold cavity top and an open mold cavity bottom, the mold cavity being shaped to form a single retaining wall block, each retaining wall block having opposed front and rear faces, opposed first and second side surfaces, and opposed and substantially parallel upper and lower surfaces, and at least one weight bearing pad extending from one of the upper and lower surfaces, the compression head assembly comprising a stripper shoe including a bottom portion for contacting a wall block surface in the mold, the bottom portion having at least one indentation for imparting to the wall block surface the at least one raised weight bearing pad; positioning the pallet beneath the mold box to enclose the mold cavity bottom; filling the mold cavity with dry cast concrete; lowering the compression head assembly to enclose the open mold cavity top and compress the dry cast concrete within the mold cavity, the at least one weight bearing pad being formed adjacent the at least one indentation; and lowering the pallet and the compression head assembly to strip the dry cast concrete from the mold cavity.

The invention provides a retaining wall comprising a plurality of courses of retaining wall blocks including a first upper course and a second lower course, each retaining wall block having opposed front and rear faces, opposed first and second side surfaces, and opposed and substantially parallel upper and lower surfaces, and at least one weight bearing pad extending from one of the upper and lower surfaces. In an embodiment, the weight bearing pads in the first upper course and the second lower course are vertically aligned. In one embodiment, the weight bearing pad extends from the lower surface.

The invention provides a method of leveling a wall block comprising providing a wall block comprising a block body having opposed front and rear faces, opposed first and second side surfaces, and opposed and substantially parallel upper and lower surfaces, at least one weight bearing pad extending from one of the upper and lower surfaces; and removing a portion of the at least one weight bearing pad to make the height of the wall block equal to an adjacent block in a course of a retaining wall.

The invention provides a mold box for making first and second wall blocks comprising first and second opposed end rails and first and second opposed side rails, the end rails and side rails together forming a mold box; a divider plate having a first end connected to the first end rail and a second end connected to the second end rail, the divider plate dividing the mold box into a first mold section for forming the first block and a second mold section for forming the second block; and pin hole molding portions attached to the divider plate.

It is to be understood that both the foregoing general description and the following detailed description are exemplary and explanatory and are intended to provide further explanation of the invention as claimed.

DETAILED DESCRIPTION OF PREFERRED EMBODIMENTS

In this application, "upper" and "lower" refer to the placement of the block in a retaining wall. The lower surface faces down, that is, it is placed such that it faces the ground. In forming a retaining wall, one row of blocks is laid down, forming a course. A second course is laid on top of this by positioning the lower surface of one block on the upper surface of another block.

The blocks of this invention may be made of a rugged, weather resistant material, such as concrete. Other suitable materials include plastic, reinforced fibers, and any other materials suitable for use in molding wall blocks. The surface of the blocks may be smooth or may have a roughened appearance, such as that of natural stone. The blocks are formed in a mold and various textures can be formed on the surface, as is known in the art. Although the embodiments described herein are discussed with reference to a wall block having a front width of 24 inches it should be appreciated that the invention is equally applicable to blocks of all sizes including those whose front faces are either larger or smaller than the ones referenced herein.

Figure 1:
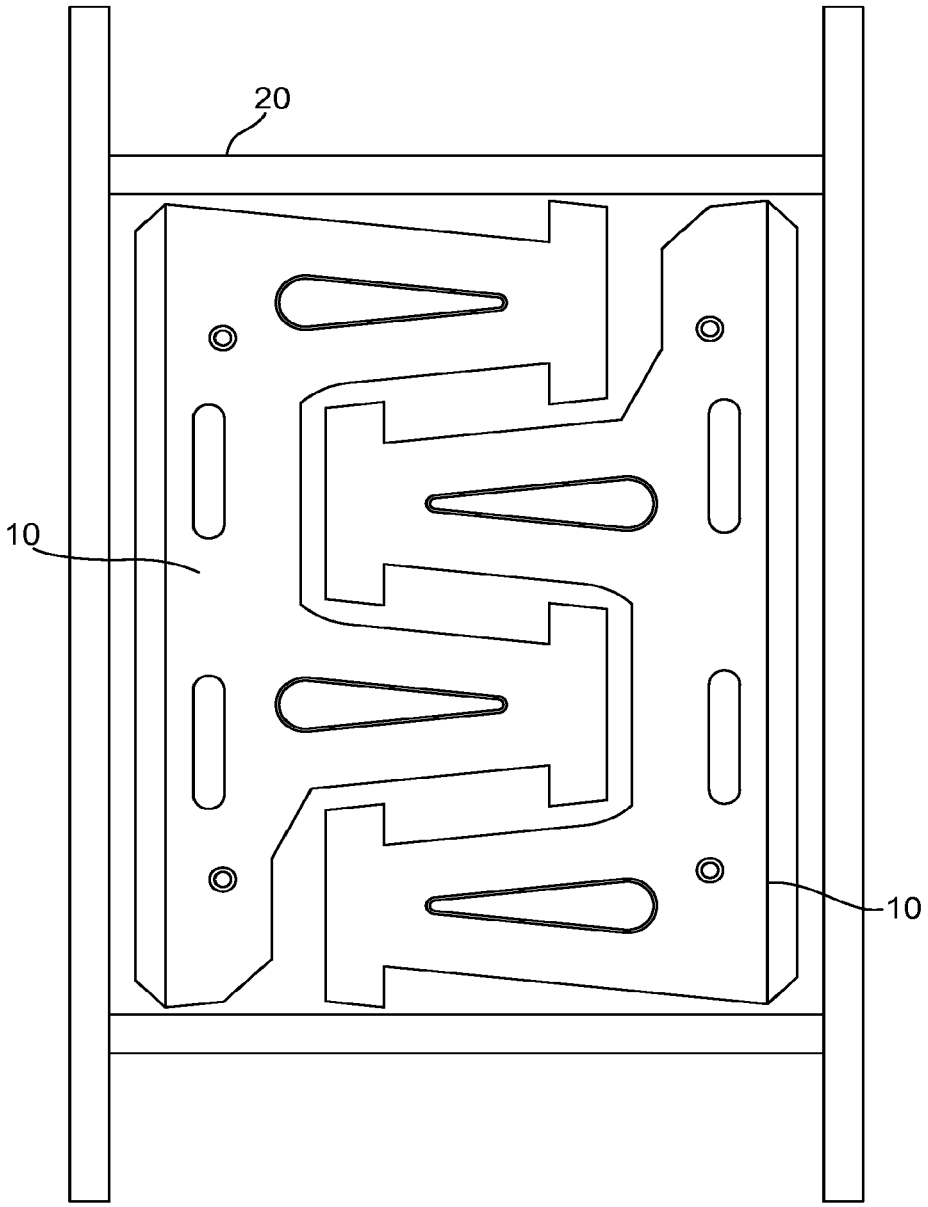
Fig. 1 (Prior Art)
FIG. 1 is a top plan view of a mold box configuration for Prior Art blocks.
Figure 2A:
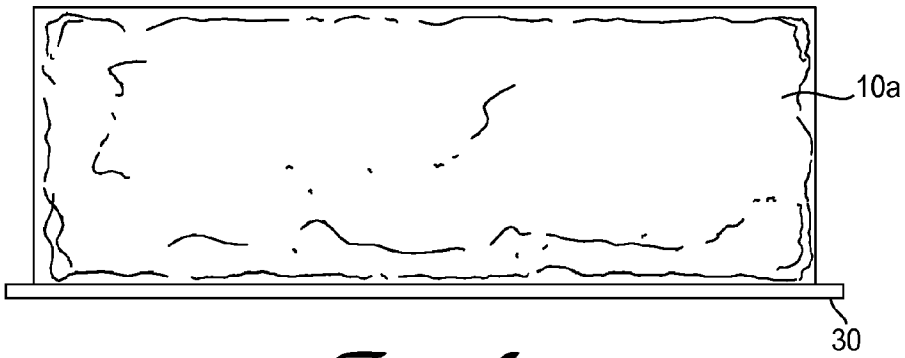
FIG. 2A is a front view of the blocks shown in FIG. 1 curing on a level pallet.
Figure 2B:
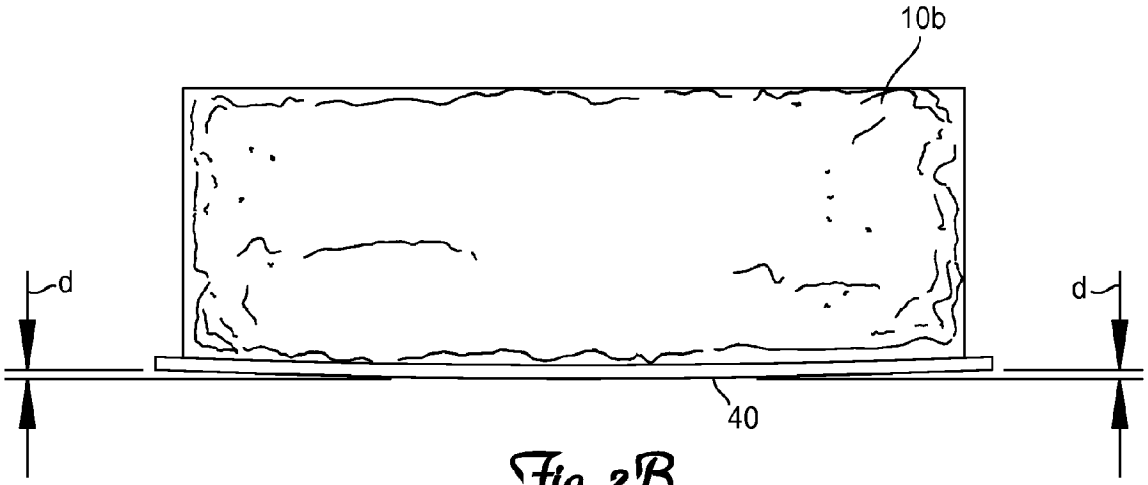
Fig. 2B (Prior Art)
FIG. 2B is a front view of the blocks shown in FIG. 1 curing on a sagging pallet.
Figure 3A:
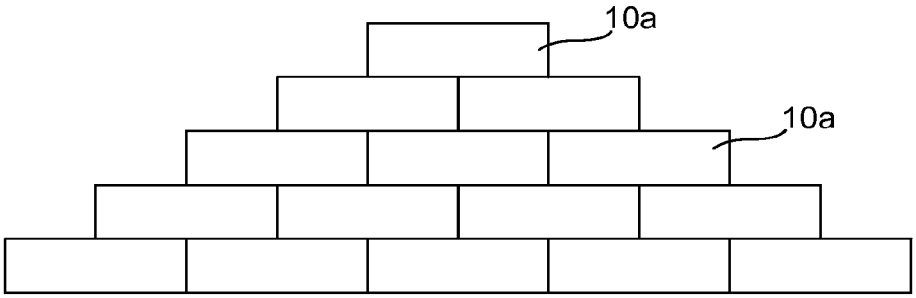
Fig. 3A (Prior Art)
FIG. 3A is a front view of a portion of a wall constructed with the blocks of FIG. 2A.
Figure 3B:
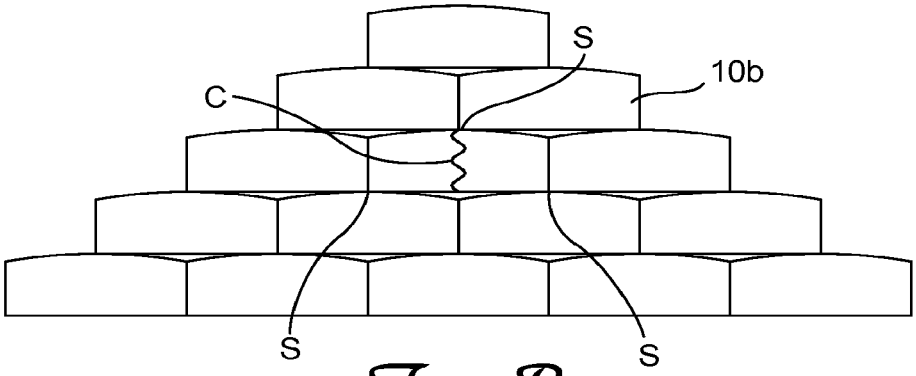
Fig. 3B (Prior Art)
FIG. 3B is a front view of a portion of a wall constructed with the blocks of FIG. 2B.

As described above due to worn or misaligned equipment used in the block manufacturing process various dimensional intolerances and surface irregularities can be unintentionally imparted to the block. More specifically as described in connection with FIGS. 1 to 3, production pallets which have gone through numerous mold cycles tend to fatigue over time and eventually start to sag. A sagging or otherwise irregular pallet imparts to the blocks the same dimensional intolerances as are present in the pallet. For many block styles and especially blocks which are meant to be used only to construct relatively low walls with few courses of blocks these dimensional intolerances do not create significant problems because the buildup of stress in areas of concentrated stress are not large enough to cause cracks in the wall. However larger blocks, because of their size, are more affected by these dimensional intolerances. Further, blocks used to construct large walls with many courses of blocks are more likely, because of the increased weight of the blocks used, to develop stresses which can cause blocks in the wall to crack. The present invention includes various embodiments that are meant to eliminate or reduce these areas of concentrated stress that are caused by dimensional intolerances which exist in the block molding process by forming on an upper or lower surface of the blocks a weight bearing pad.

Figure 4:
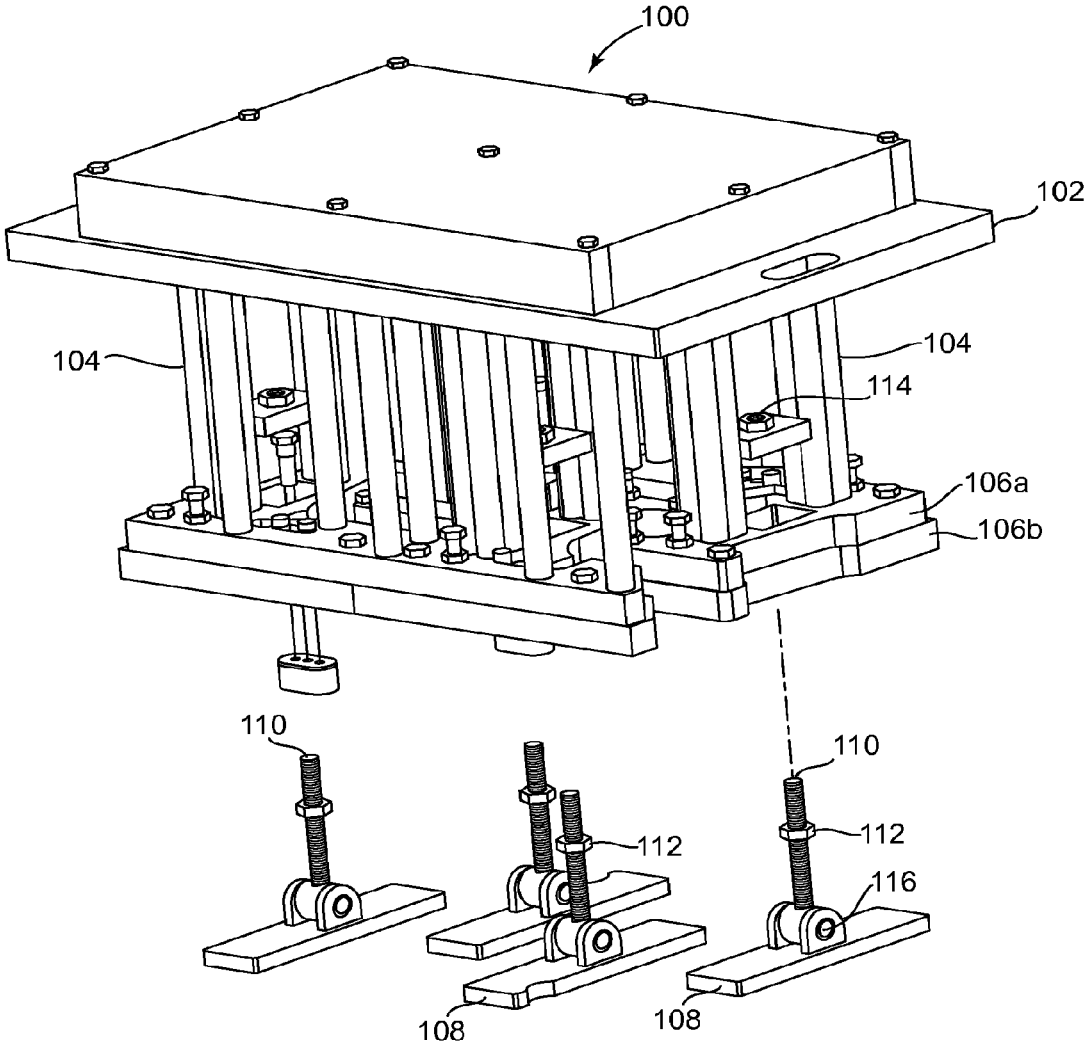
FIG. 4 is a perspective view of a compression head assembly having adjustable tamper heads according to a first embodiment of the invention.
Figure 5A:
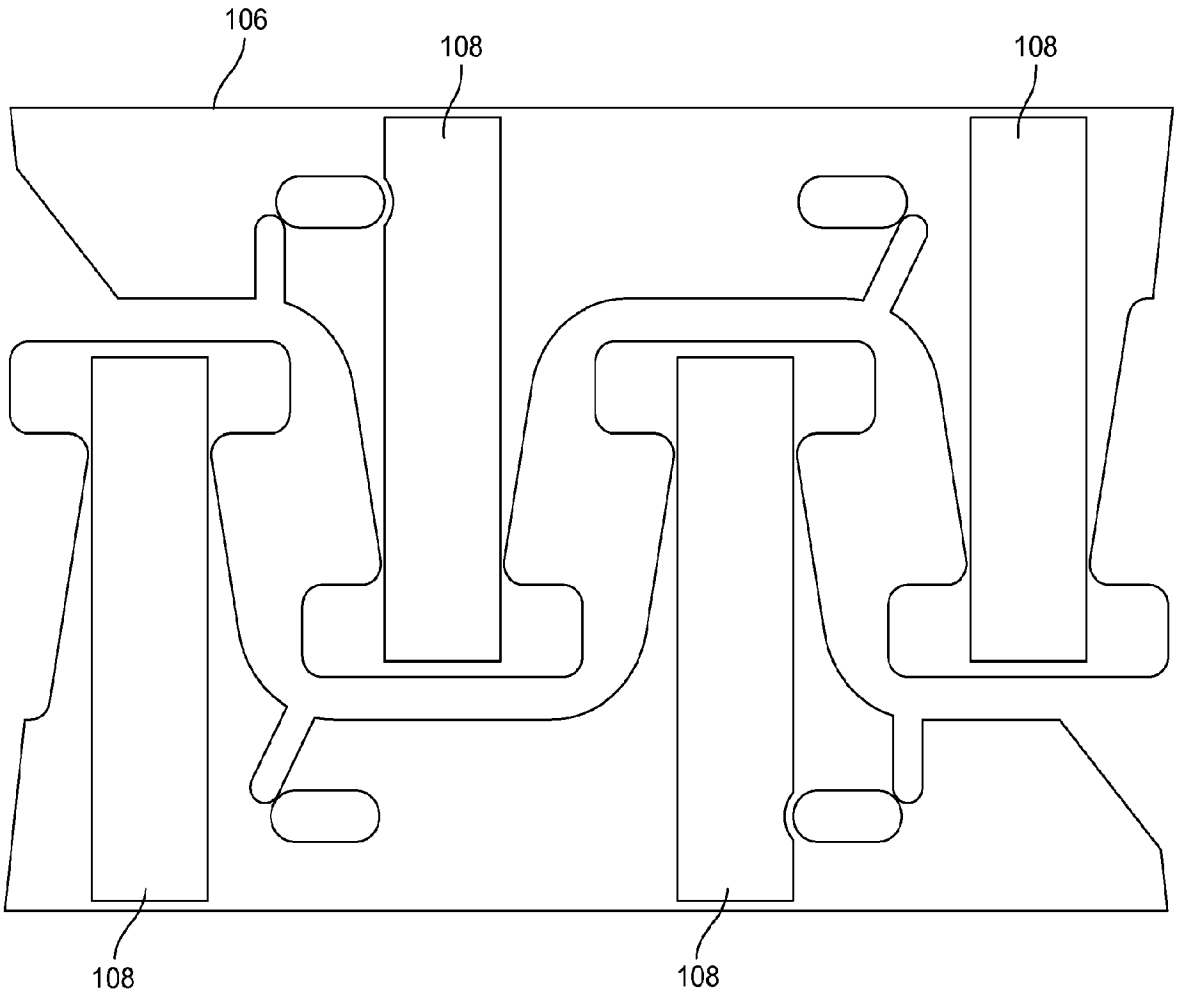
FIG. 5A is a bottom plan view of the compression head assembly of FIG. 4.
Figure 5B:
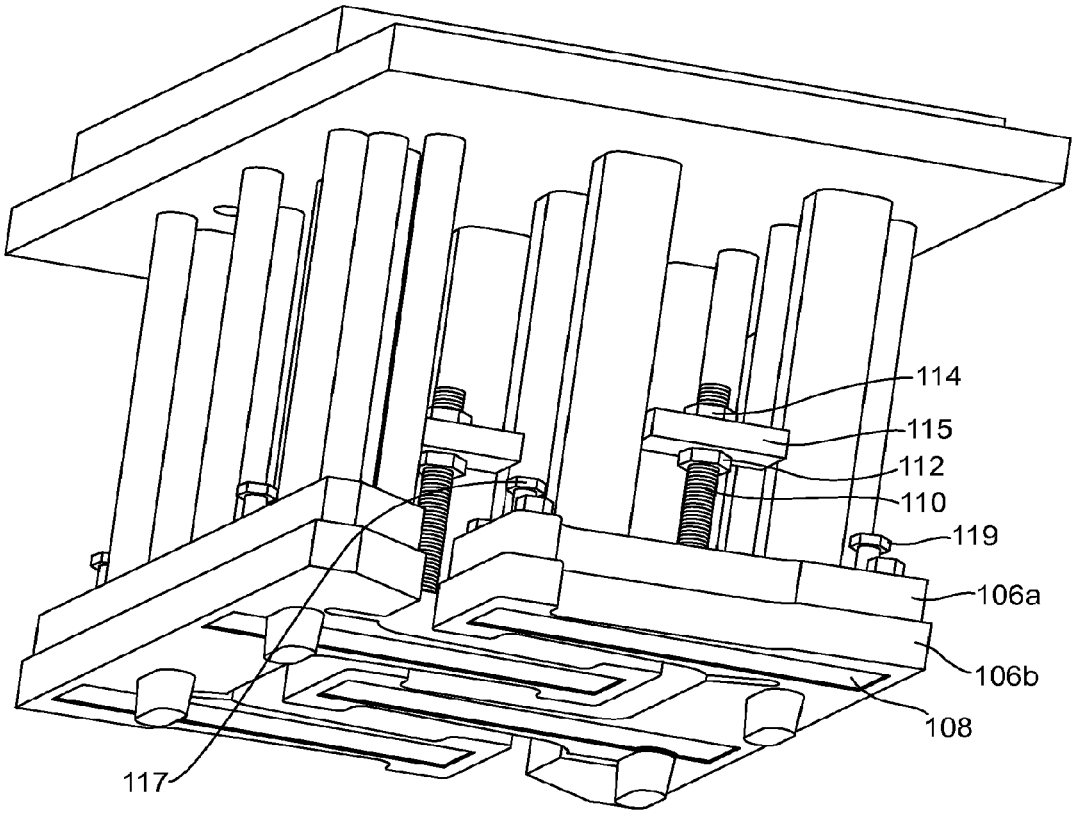
FIG. 5B is a bottom perspective view of the compression head assembly of FIG. 4.
Figure 5C:
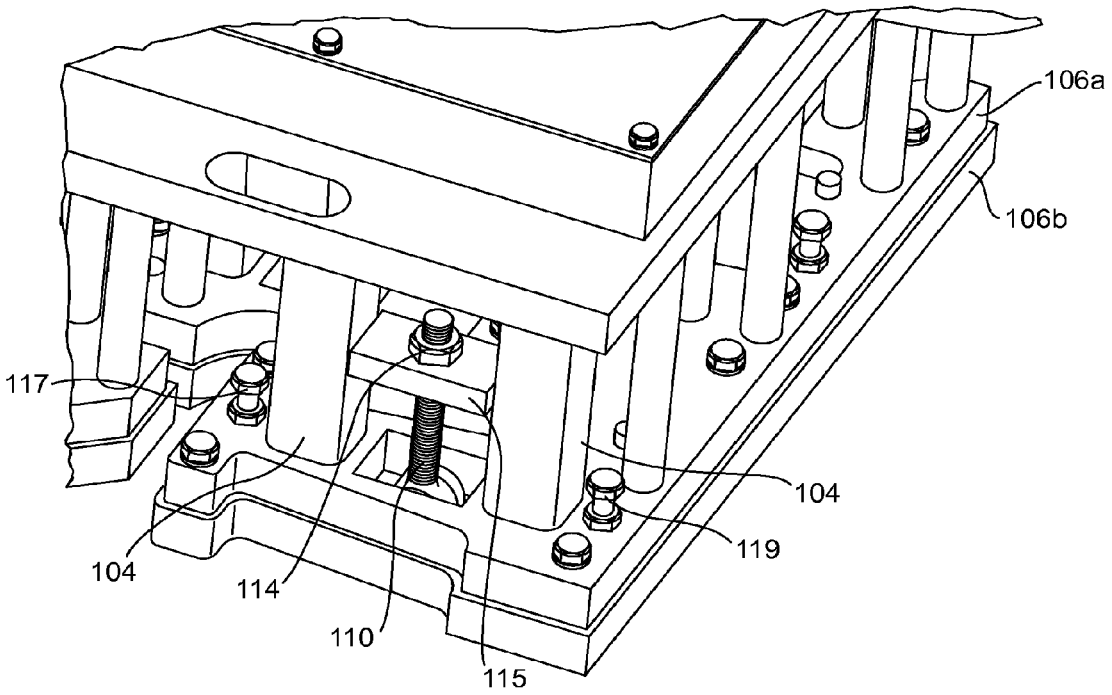
FIG. 5C is a top perspective view of the compression head of FIG. 4.

FIG. 4 is a perspective view of a compression head assembly in accordance with one embodiment of the present invention. Compression head assembly 100 includes a stripper head plate 102 and a stripper shoe 106 comprising an upper portion 106*a* and a lower portion 106*b*. A plurality of stripper plungers 104 are attached between the stripper head plate 102 and the upper portion 106*a* of the stripper shoe. For purposes of illustration a plurality of tamper heads 108 which may be adjustable in the manner described further below are shown disconnected from the compression head assembly 100. When connected the tamper heads are received within compatible openings in the bottom of the lower portion 106*b* of the stripper shoe as best seen in FIGS. 5A, 5B and 5C which are a bottom plan view of the stripper shoe and bottom and top perspective views of the compression head assembly, respectively. The tamper heads are provided for the purpose of forming weight bearing pads on a bottom surface of blocks which are formed in a block molding process using the compression head assembly in a manner which will be described in more detail hereafter.

The adjustable tamper heads 108 are attached to threaded shafts 110. Shafts 110 are received in apertures in plates 115. Plates 115 are connected between plungers 104. The depth that the tamper heads are received into lower portion 106*b* is set by adjusting nuts 112 and 114 to raise or lower shafts 110. Each tamper head 108 pivots with respect to shaft 110 at pivot point 116. The angle at which the tamper heads pivot or tilt is adjustable by using set screws 117 and 119 which are threaded into holes in the upper portion 106*a* of the stripper shoe. By adjusting the depth by which set screws 117 and 119 extend into and through upper portion 106*a* the angle of the tamper heads 108 can be adjusted in teeter totter fashion.

Figure 6:
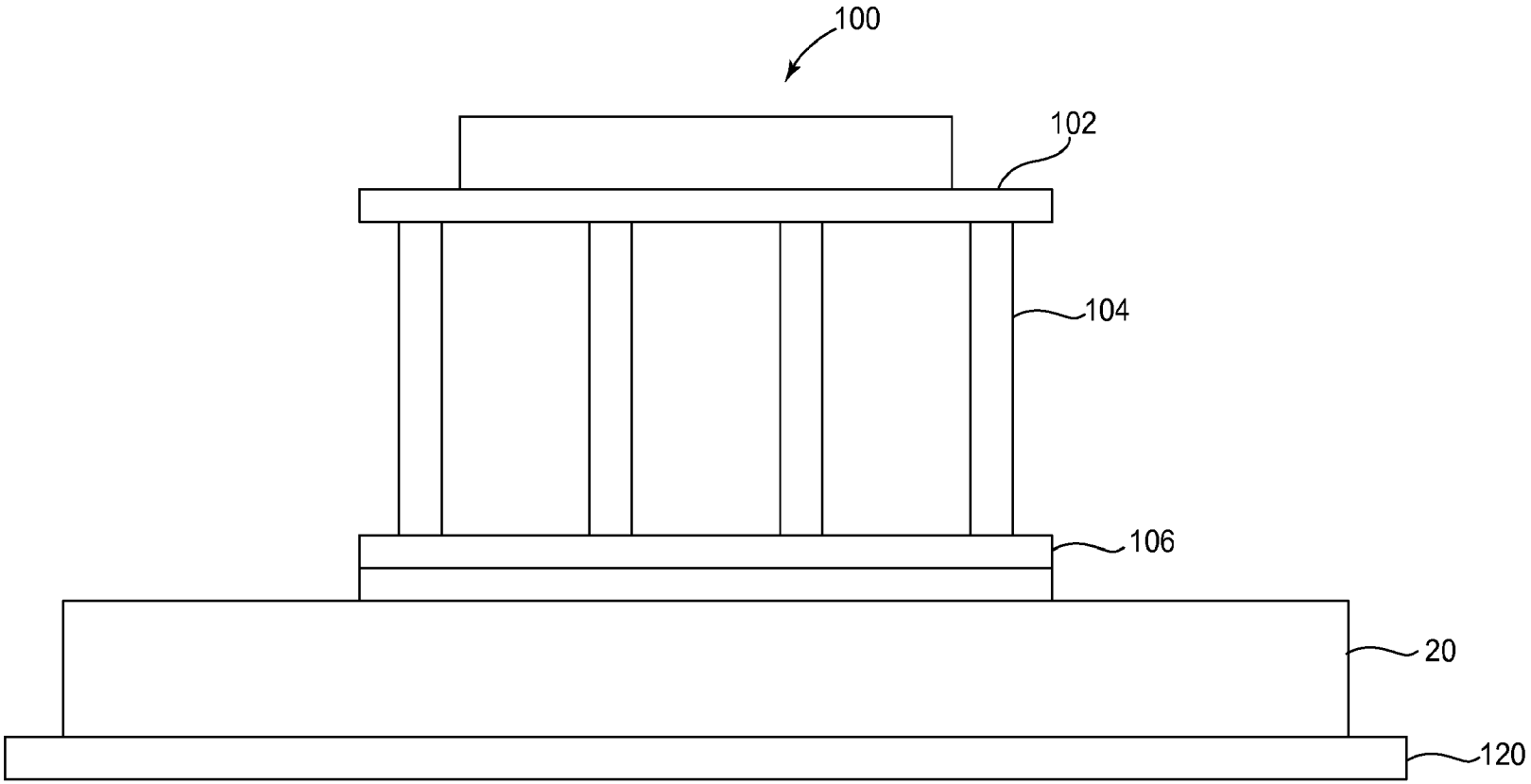
FIG. 6 is a front view of the compression head assembly of FIG. 4 positioned over a wall block mold box and production pallet.

FIG. 6 is a front view of compression head assembly 100 positioned over a mold box 20 and pallet 120 during a block forming process. As known in the art the stripper shoe is discontinuous to avoid contact with any core bars or cores that may be used in the block forming process. Once the mold box has been filled with the moldable material and the material has been vibration compacted to hold its shape the compression head assembly is lowered to push the material out of the mold box. The material in the form of wall blocks remains on the pallet and is moved to a curing station.

Figure 7:
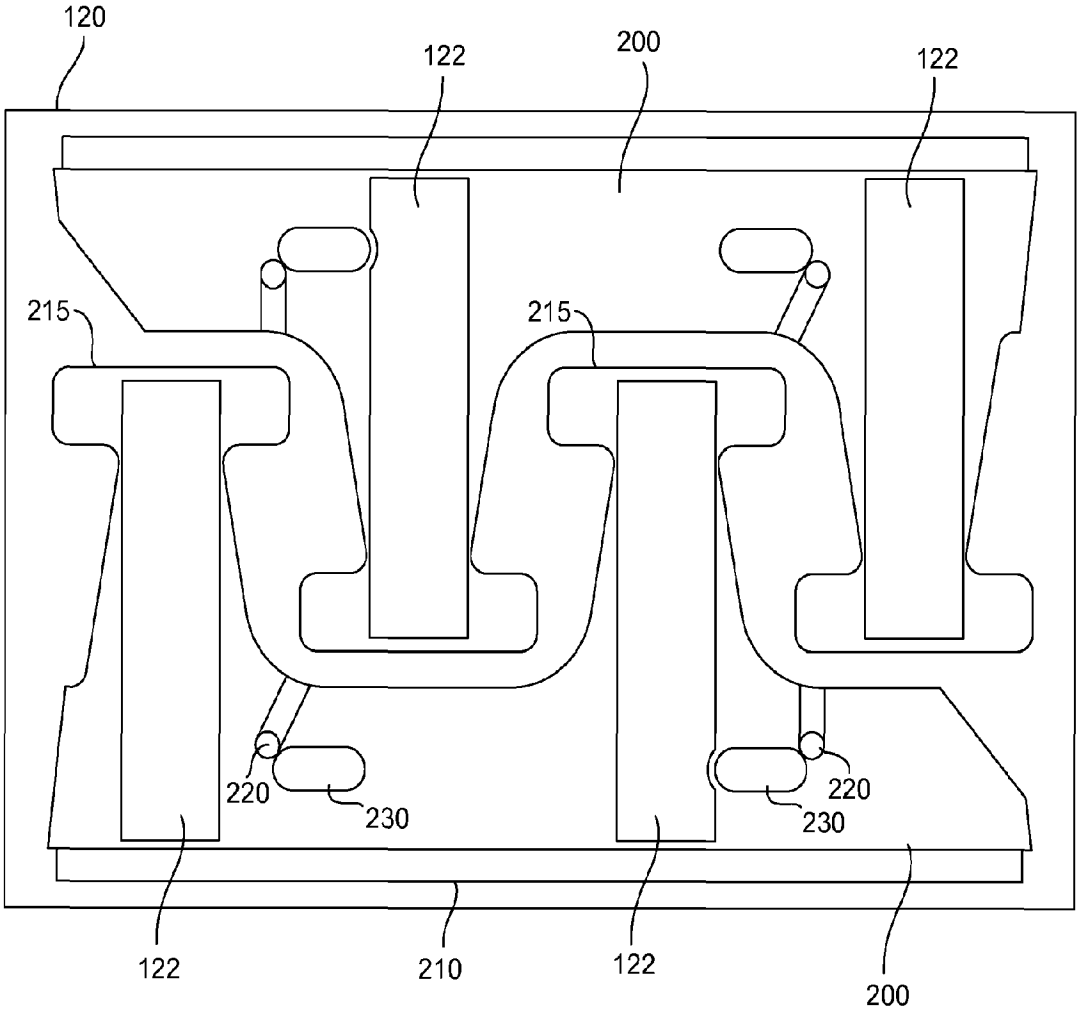
FIG. 7 is a top view of wall blocks removed from the mold of FIG. 6 and curing on a pallet.
Figure 11:
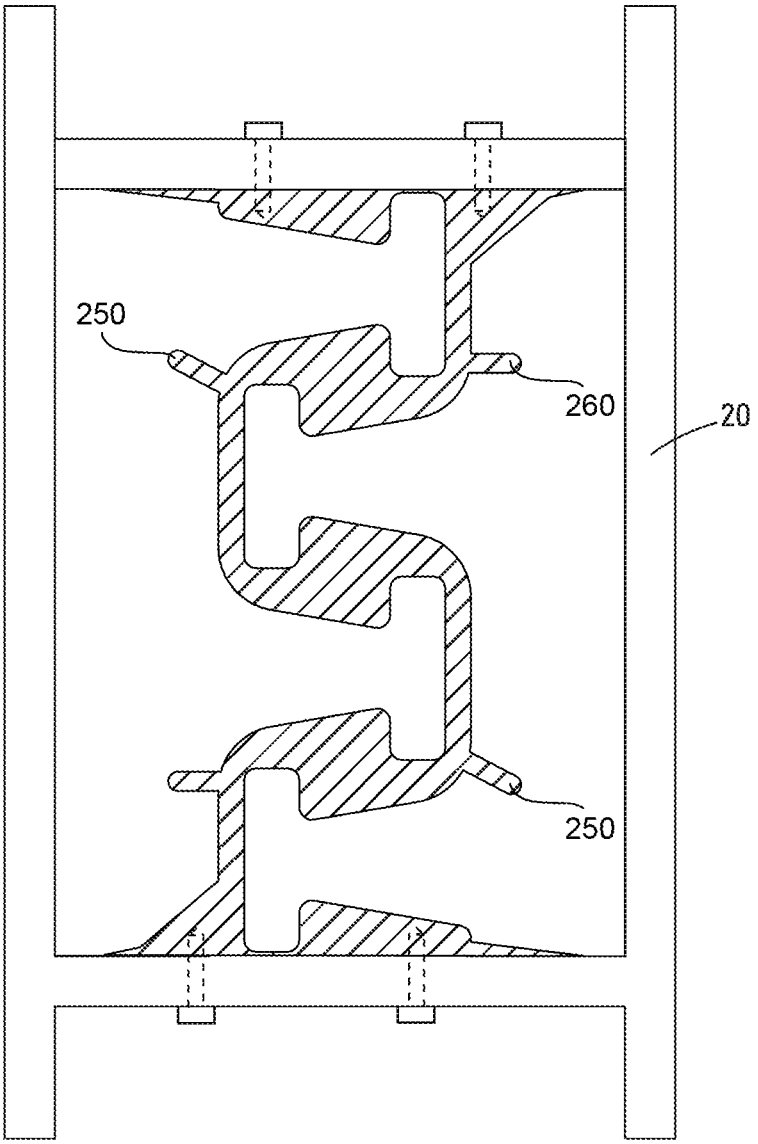
FIG. 11 is a plan view of a mold box showing a divider plate.

FIG. 7 is a top view of blocks 200 formed in the process shown in FIG. 6. Blocks 200 are shown resting on the pallet 120 in the curing station. The blocks 200 have front faces 210 that can have any texture and can have a bevel. The blocks also have rear faces 215. The blocks 200 also have pin holes 220 and pin receiving cavities 230. Pins are often placed in the blocks in the process of making a wall. Pin hole mold portions 250 are attached to a divider plate 260, which is attached to the mold box 20 as shown in FIG. 11.

Figure 8:
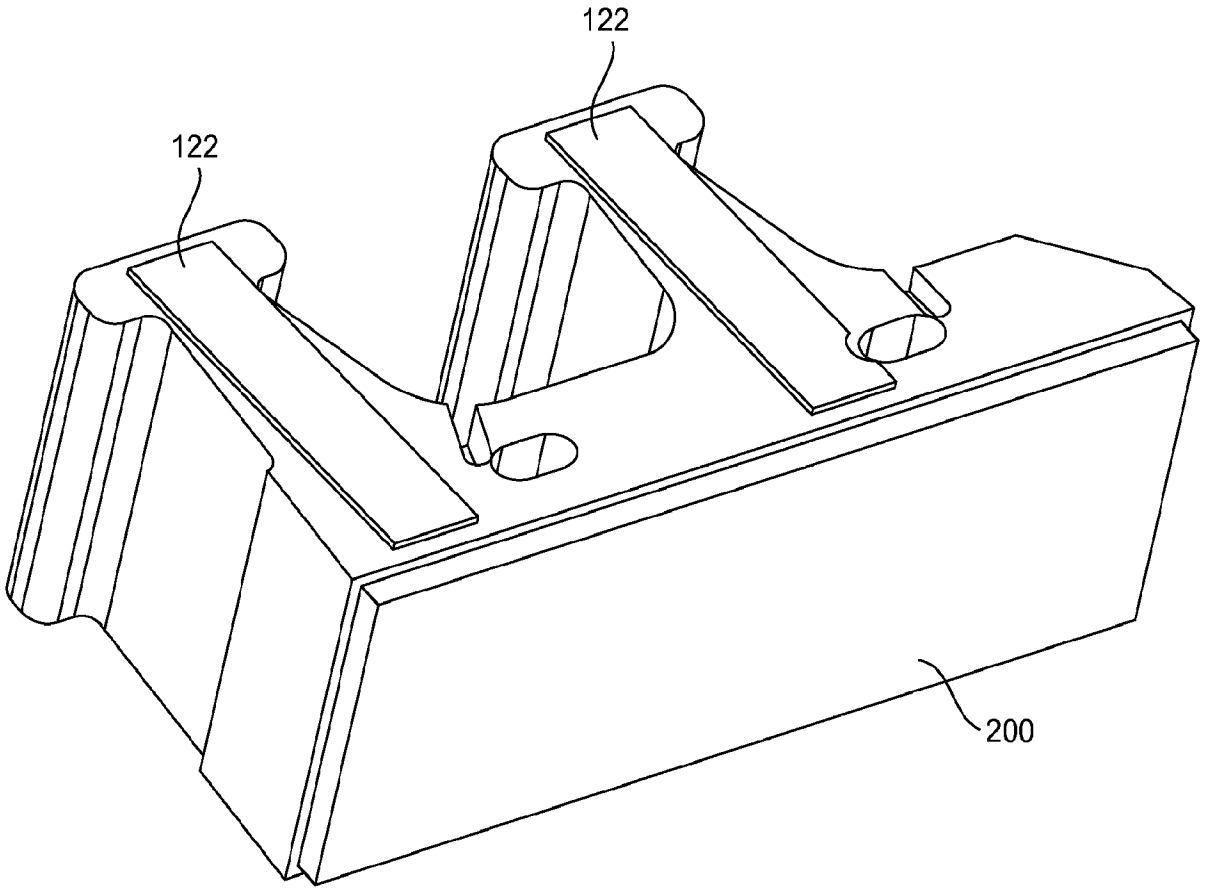
FIG. 8 is a perspective view of one of the blocks shown in FIG. 7.

Since the bottom surfaces of the blocks are oriented upwards in the mold, FIG. 7 shows the bottom surfaces of the blocks as they would be used in forming a wall. The adjustable tamper heads which are recessed into lower portion 106*b* of the shoe impart to the bottom surface of each of the blocks a plurality of raised surfaces 122 which function as weight bearing pads. In this embodiment two weight bearing pads are formed but it should be understood that the number and position of the weight bearing pads can be varied. The amount by which each pad is raised from the bottom surface of the blocks depends on the extent of curvature or other irregularity that is imparted to the block by the pallet or other portion of the mold machinery or equipment. For example, if the pallet is fatigued and sags at each end by from 3/32 to 1/8 of an inch (0.2 to 0.3 cm) the adjustable tamper heads can be set to form the weight bearing pads to extend from the bottom surface of the block by up to 1/4 inch (0.64 cm) or more if desired. During the block forming process adjustments to the adjustable tamper heads can be made based on measurements taken from blocks which have been previously made. These measurements may require that the amount that the weight bearing pads extend from the blocks be increased or decreased. This is done by adjusting the amount by which the tamper heads are recessed into lower portion 106*b* of the stripper shoe. Further, it may be desirable to increase or decrease the amount by which the pads are angled or sloped from the front of the blocks to the back. This angle may be adjusted in the range of from about 0° to 5°. A perspective view of one of the blocks 200 is shown in FIG. 8. Although the compression head assembly is shown in the drawings as including four adjustable tamper heads which form two weight bearing pads 122 on each block it will be apparent to those of skill in the art that more or fewer tamper heads could be used to form more or fewer weight bearing pads on each block depending on how many blocks are formed in the mold box, the size of the blocks, use requirements, and on the desired amount of weight distribution points. Further, although the tamper heads are shown as being adjustable both in the depth they are recessed into lower portion 106*b* and in their slope it should be understood that the tamper heads could be made adjustable only as to amount of recess or only as to degree of slope. Further, the tamper heads need not be adjustable at all. In fact the tamper heads need not be separate components from the stripper show but may comprise recesses formed into the bottom surface of lower portion 106*b* to a depth in the range of about 1/8" to 3/8" (0.3 to 1 cm). Further, although in the manufacturing process described herein the bottom surfaces of the blocks face upward in the mold box it is also possible to form wall blocks with the upper block surface facing upwards so that the weight bearing pads may be formed on either the upper or lower block surface depending on how the block is oriented in the mold.

Figure 9:
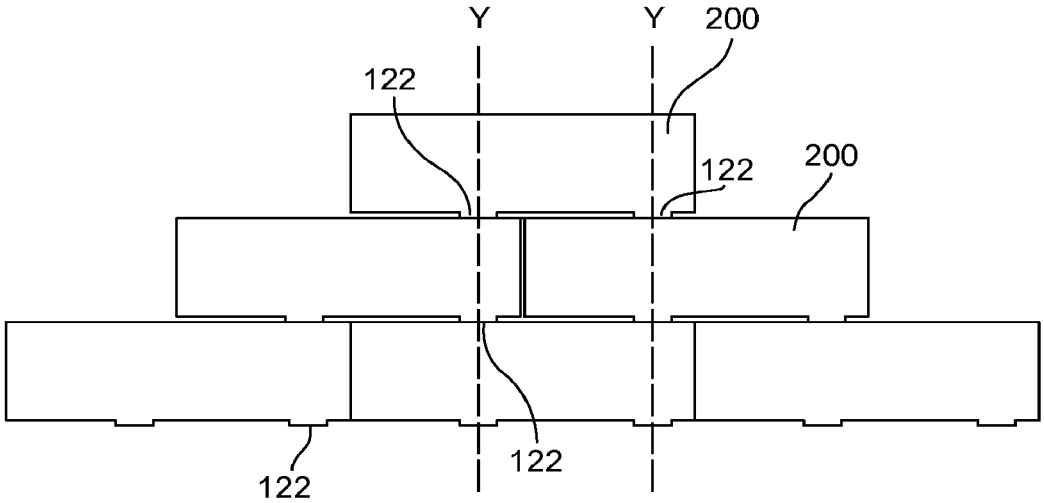
FIG. 9 is a front view of a portion of a wall built with blocks shown in FIGS. 7 and 8.

FIG. 9 is a front view of a wall constructed in an overlapped or running bond pattern with the blocks of FIGS. 7 and 8. As can be seen each course of blocks contacts an adjacent lower course of blocks only at weight bearing pads 122. Thus, the weight of the blocks from upper courses of blocks is applied only at the locations of the weight bearing pads 122. The pads are positioned on the blocks so that these load or stress areas are formed directly above a weight bearing pad on the underlying block. In other words, when a wall is formed from the blocks 200 in a running bond pattern as shown in FIG. 9 the pads in each course align vertically along lines Y. Since there are no areas of high stress that do not have underlying support, the problem of block cracking is eliminated even if the block thickness is not consistent within an acceptable range as may be caused by worn, misaligned or irregular equipment or machinery used in the block molding process.

Figure 10:
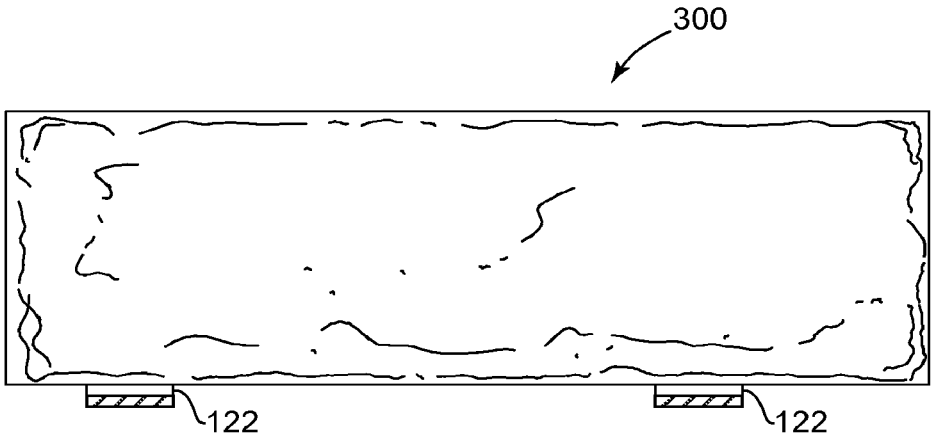
FIG. 10 is a front view of a wall block which has been modified in accordance with a further embodiment of this invention.

FIG. 10 illustrates a further embodiment of the invention which illustrates a method of leveling a portion of a surface of a wall block. In this embodiment a block 300 is provided with weight bearing pads 122. Weight bearing pads 122 are formed in the molding process using a stripper shoe having a recessed tamper head as described above. However, for purposes of this embodiment the tamper heads may be separate components which are adjustable as described above or they may be recesses formed into the bottom surface of lower portion 106*b* for which no adjustment is possible. They may be recessed by a desired amount, for example, ¼ inch (0.64 cm). Once the blocks have been formed with the weight bearing pads the height of those pads may be adjusted, if necessary, based on measurements taken after the blocks have been formed. The height adjustment is made by grinding, planning or otherwise removing a portion of the weight bearing pads shown as cross-hatched in FIG. 10 so that the block height at those locations is consistent from block to block. This is advantageous since it is not necessary to control the height of the block at all locations but only at the location of the weight bearing pads. In other words, the block need only be formed with standard sized weight bearing pads which are then mechanically adjusted if necessary to maintain correct height tolerance for the block by removing or planning an appropriate amount of material from only the weight bearing pad. Shims could also be used in this process.

Although particular embodiments have been disclosed herein in detail, this has been done for purposes of illustration only, and is not intended to be limiting with respect to the scope of the following appended claims. In particular, it is contemplated by the inventor that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein. Further, although the invention has been described in connection with blocks having height inconsistencies or intolerances due to forming the blocks on a sagging pallet it should be understood that these inventive concepts and embodiments are also applicable to control height tolerances on any block having height inconsistencies caused by any reason.

What is claimed is:

1. A retaining wall comprising a plurality of courses of retaining wall blocks including a first upper course and an adjacent second lower course, each retaining wall block having opposed front and rear faces, the rear face having at least a first surface and a second surface, opposed first and second side surfaces, an upper surface opposed and substantially parallel to a lowermost surface of the block, and at least a first and second weight bearing pad extending from the upper surface, the block having a depth as measured from the front face to the rear face, the first weight bearing pad extending between the first surface of the rear face and the front face of the block more than half but less than all of the length of the depth of the block and the second weight bearing pad extending between the second surface of the rear face and the front face of the block more than half but less than all of the length of the depth of the block, the at least first and second weight bearing pads having a height, wherein the weight bearing pads are positioned such that the lowermost surface of the blocks of the first upper course are spaced the height of the weight bearing pad from the upper surface of the blocks of the adjacent lower course.

2. The retaining wall of claim 1, wherein the first surface of the rear face is inset a first distance from the first side surface of the retaining wall block and the second surface of the rear face is inset a second distance from the second side surface.

3. The retaining wall of claim 2, wherein the first distance is different from the second distance.

4. The retaining wall of claim 1, wherein the retaining wall blocks have at least one pin hole opening onto the upper and lowermost surfaces and at least one pin receiving cavity opening onto at least one of the opposed upper and lowermost surfaces.

5. The retaining wall of claim 4, further comprising pins.

6. The retaining wall of claim 4, wherein the at least one pin receiving cavity opens onto at least a portion of at least one of the first and second weight bearing pads.

7. A retaining wall comprising a plurality of courses of retaining wall blocks including a first upper course and an adjacent second lower course, each retaining wall block having a block body with opposed front and rear faces, opposed first and second side surfaces, an uppermost surface opposed and substantially parallel to a lowermost surface, and a depth as measured from the front face to the rear face, each retaining wall block having at least first and second weight bearing pads extending from one of the uppermost and lowermost surfaces of the block body, the at least first and second weight bearing pads extending between the rear face and the front face of the block more than half but less than all of the length of the depth of the block body, the first weight bearing pad being inset from the first side surface a first distance and the second weight bearing pad being inset from the second side surface a second distance, the first distance being different than the second distance, the at least first and second weight bearing pads having a height, at least one pin hole opening onto the opposed uppermost and lowermost surfaces of the block body, and at least one pin receiving cavity opening onto at least one of the opposed uppermost and lowermost surfaces of the block body, wherein the at least first and second weight bearing pads are positioned on the block body such that the lowermost surface of the block body of at least some of the blocks of the first upper course are spaced the height of the weight bearing pads from the uppermost surface of the block body of at least some of the blocks of the adjacent second lower course.

8. The retaining wall of claim 7, further comprising pins.

9. A method of making a retaining wall comprising:

providing a plurality of retaining wall blocks, each retaining wall block having a block body with opposed front and rear faces, the rear face having at least a first surface and a second surface, opposed first and second side surfaces, an uppermost surface opposed and substantially parallel to a lowermost surface, and a depth as measured from the front face to the rear face, each retaining wall block having at least a first and second weight bearing pad extending from one of the uppermost and lowermost surfaces of the block body, the first weight bearing pad extending between the first surface of the rear face and the front face of the block more than half but less than all of the length of the depth of the block body and the second weight bearing pad extending between the second surface of the rear face and the front face of the block more than half but less than all of the length of the depth of the block body, the at least first and second weight bearing pads having a height;

placing the retaining wall blocks into a first course; and placing the retaining wall blocks into a second course wherein the weight bearing pads are positioned such that the lowermost surface of the block body of at least some of the blocks of the upper second course are spaced the height of the weight bearing pad from the uppermost surface of the block body of at least some of the blocks of the lower first course.

10. The method of claim 9, wherein the first surface of the rear face is inset a first distance from the first side surface of the plurality of retaining wall blocks and the second surface of the rear face is inset a second distance from the second side surface of the plurality of retaining wall blocks.

11. The method of claim 10, wherein the first distance is different from the second distance.

12. The method of claim 9, wherein the plurality of retaining wall blocks have at least one pin hole opening onto the opposed uppermost and lowermost surfaces of the block body and at least one pin receiving cavity opening onto the lowermost surface of the block body.

13. The method of claim 12, wherein the at least one pin receiving cavity of the plurality of retaining wall blocks opens onto at least a portion of at least one of the first and second weight bearing pads.

14. The method of claim 12, further comprising:

inserting pins into at least some of the pin holes of the retaining wall blocks that have been placed in the first course such that the pins are then received in the pin receiving cavities of the retaining wall blocks of the second course when the blocks of the second course are placed.

15. The method of claim 12, wherein the first surface of the rear face is inset a first distance from the first side surface of the plurality of retaining wall blocks and the second surface of the rear face is inset a second distance from the second side surface of the plurality of retaining wall blocks.

16. The method of claim 15, wherein the first distance is different from the second distance.

* * * * *